United States Patent [19]

Schuetzeberg et al.

[11] 4,310,190

[45] Jan. 12, 1982

[54] SKI AND SKI POLE CARRYING APPARATUS

[76] Inventors: Jerome H. Schuetzeberg, 5703 -37th St., Lubbock, Tex. 79416; Roy L. Schuetzeberg, 3207 - 67th St., Lubbock, Tex. 79413

[21] Appl. No.: 214,060

[22] PCT Filed: Mar. 6, 1980

[86] PCT No.: PCT/US80/00327

§ 371 Date: Mar. 6, 1980

§ 102(e) Date: Mar. 6, 1980

[87] PCT Pub. No.: WO81/02525

PCT Pub. Date: Sep. 17, 1981

[51] Int. Cl.[3] ..... A63C 11/02

[52] U.S. Cl. ..... 294/147; 280/814; 294/169

[58] Field of Search ..... 294/143, 147, 149–155, 294/157, 159, 161–163, 165, 167, 169; 211/60 SK; 224/197, 200, 218, 250, 251, 270, 272, 917; 280/814, 815

[56] References Cited

U.S. PATENT DOCUMENTS

| | | | |
|---|---|---|---|
| 3,307,759 | 3/1967 | Fulton | 294/147 |
| 3,718,242 | 2/1973 | Larson | 294/147 |
| 3,877,623 | 4/1975 | Breault | 294/147 |
| 3,935,977 | 2/1976 | Bonnett | 294/147 |
| 4,190,182 | 2/1980 | Hickey | 294/147 |

FOREIGN PATENT DOCUMENTS

| | | | |
|---|---|---|---|
| 2358171 | 3/1978 | France | 280/814 |

*Primary Examiner*—Johnny D. Cherry
*Attorney, Agent, or Firm*—Ely Silverman

[57] ABSTRACT

In the expanded ski and pole carrying operative array of the member parts of the ski and pole carrier, the position of skis and poles held by the carrier are positively managed by the operator because the skis and poles are firmly and positively positioned by the combination therewith of rigid connected ski-holding and orienting members and resilient clamping members. The rigid orienting members are sized and shaped and pivotally movable and reconnectable to be formed in a compact nested array wherein the larger members enclose the smaller members to protect the thin-edged members thereof and form a stable compact pocket-sized structure free of projecting sharp edges, which compact array is quickly and surely formed into the expanded ski and ski-pole carrying array of parts.

10 Claims, 24 Drawing Figures

SKI AND SKI POLE CARRYING APPARATUS

CROSS REFERENCE TO RELATED APPLICATION

A related application is U.S. Design Patent Application Ser. No. 931,826 D filed Aug. 7, 1978, now abandoned for ski Clamp by JEROME H. SCHUETZEBERG and ROY L. SCHUETZEBERG.

SUMMARY OF THE INVENTION

The prior art has provided sling type supports for skis and ski poles and box type supports; the sling types as in U.S. Pat. Nos. 3,976,234 and 3,675,835 and 3,486,672 do not provide positive control of the movement of the skis carried thereby and are difficult to assemble firmly and the box types as in U.S. Pat. Nos. 3,935,977 and 4,059,209 and 3,370,766 are not convenient to carry when not in use and suffers from slippage.

In the expanded position of its members the ski and ski pole carrying apparatus (30) of this invention (shown in FIGS. 1, 7 and 12) provides positive controllable positioning of the skis and ski poles held therein because the skis and poles are firmly and positively positioned by the combination of those skis and poles and rigid and firmly connected handle assembly (61), ski holder assembly (62), and ski pole holder assembly (63) of the apparatus (30). The members of the ski and ski pole carrying apparatus are so sized, shaped and pivotally movable when not connected to skis or poles as to be readily formed into a compact nested array as in FIG. 9 wherein the largest member—the handle assembly (61)—encloses the smaller ski holder assembly (62) and the ski holder assembly encloses the ski pole holder assembly (63) and protects the thin-edged members thereof, all to form a stable compact pocket-sized structure free of projecting sharp edges; such compact array is quickly and surely formed into the expanded ski and ski-pole carrying structure and connected to the skis and ski poles.

BRIEF DESCRIPTION OF THE DRAWINGS

FIGS. 1, 2 and 4 are to scale and are the same scale; FIGS. 6 and 7 are to scale; FIGS. 8–13, 14, 16–20, 23 and 24 are to scale and are the same scale. Dimensions of a particular embodiment are set out in Table I.

DESCRIPTION OF THE PREFERRED EMBODIMENT

Figure 1:
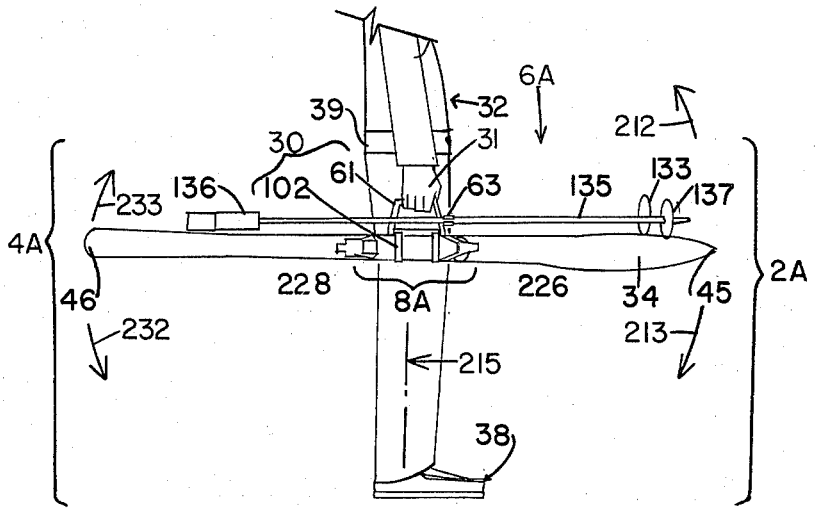
FIG. 1 is a side view, in overall, of a pair of skis held in the ski and ski pole carrying assembly 30 of this invention and carried by an operator 32.

The ski and ski pole carrying assembly 30 comprises a handle assembly 61, a ski holder assembly 62 and a ski pole holder assembly 63, (below referred to as a pole holder assembly) in cooperative combination.

In operation, the ski and ski pole carrying assembly 30 of this invention is carried in the one hand 31 of the operator 32 and serves to carry a pair of skis as 33 and 34 and a pair of ski poles as 35 and 36, as shown in FIGS. 1–7. In such operative position of the parts of assembly 30 the handle assembly 61 of the ski and ski pole carrying assembly 30 is (a) pivotally yet firmly attached to and supports the ski holder assembly 62 and the pole holder assembly 63 and (b) through the ski holder assembly 62 supports and guides the skis 33 and 34 and (c) through the ski pole holder assembly 63 supports the ski pole assemblies 35 and 36.

Figure 9:
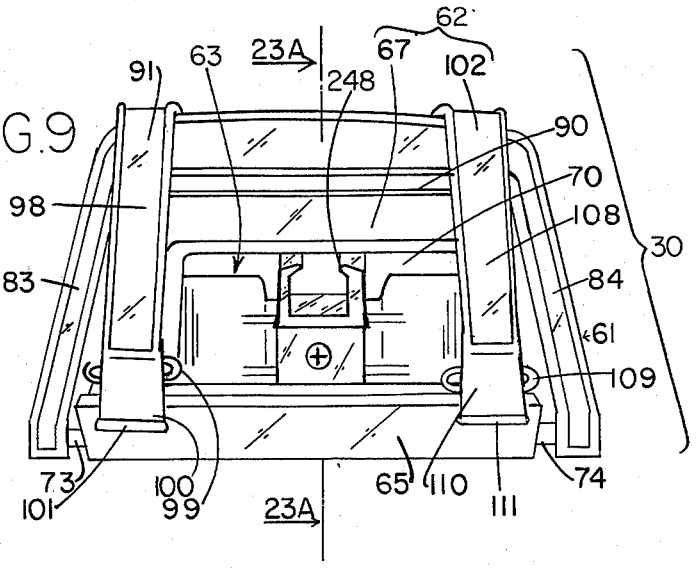
FIG. 9 is a side view showing the compacted nested carried position of parts of the ski and ski pole carrying assembly 30.
Figure 23:
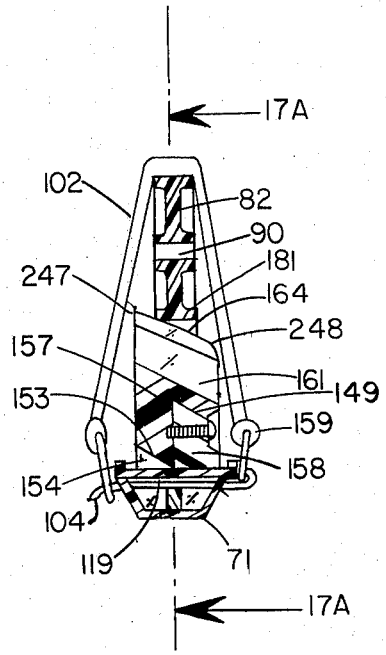
FIG. 23 is a sectional view along section 23A—23A of FIG. 9 showing relations of the parts of the ski pole and ski pole carrying assembly 30 in its stable, compacted, nested, array of parts.

In the compacted nested position of the ski and ski pole carrying assembly 30 as shown in FIGS. 9 and 23 the handle assembly 62 encloses as well as supports the ski holder assembly 62 and the ski holder assembly 62 encloses and supports the ski pole holder assembly 63 whereby an assembly which is readily carried in the pocket of the skier is provided while he is using the skis and ski poles.

The terms left and right are used as shown in FIGS. 1 to 7 to indicate, respectively, the left and right side of the operator ski porter (32) as shown by the left foot 37 and right foot 38 of the operator porter 32 and corresponding parts of the apparatus 30. The front end (or tip) 45 and the rear end (or heel) end of the right hand ski 36 are shown in FIGS. 1, 2, 4, and 6 and indicate front and rear positions referred to herebelow.

The ski holder assembly 62 comprises, in operative combination, a ski holder assembly frame 66 (see FIGS. 8 and 10), a front band 91 and a rear band 102.

The ski holder assembly frame 66 comprises a ski holder assembly base 65, a longitudinal rigid horizontal bar 67, a rigid front support bar 68, and a rigid rear support bar 69; the rear of bar 68 is joined firmly to the front end of the bar 67 and the rear end of the bar 67 is joined to the front end of arm 69.

Figure 10:
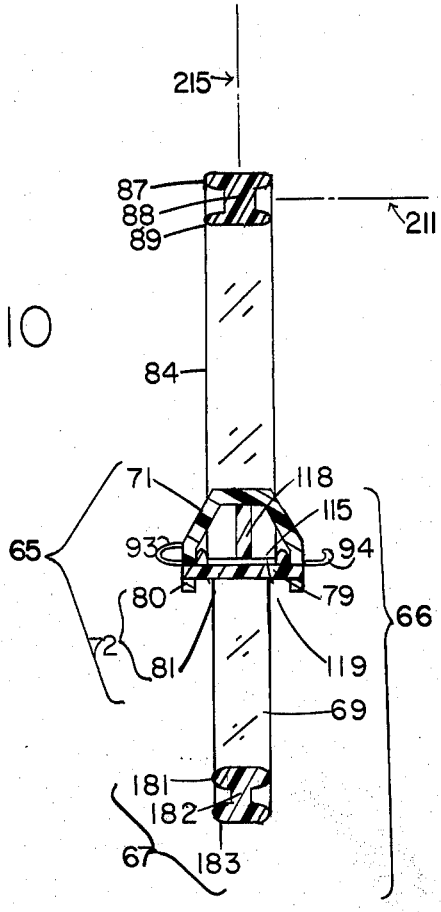
FIG. 10 is a sectional view taken along the vertical section 10A—10A of FIG. 8 transverse to the length of the assembly 30.

The bars 67, 68 and 69 of the ski holder assembly frame 66 are each "H" shaped in section as shown in FIG. 10; the "H" shape inner plate 181 is joined by a web portion 182 to an outer plate portion 183.

The base 65 is firmly joined to the front and rear support bars 68 and 69. Between the bars 67, 68, 69 and the base (65) is a ski holder assembly frame enclosure space 70 within which, in the carried position of the parts of assembly 30, the ski pole holder assembly 63 is carried as shown in FIGS. 9 and 23.

Figure 17:
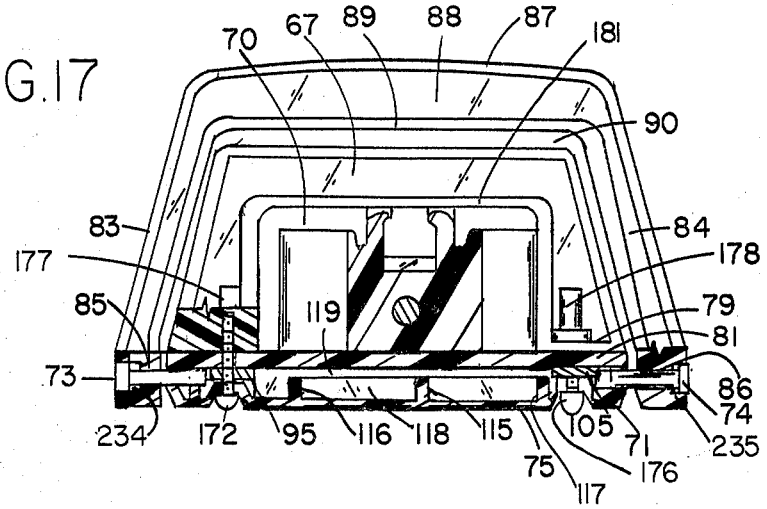
FIG. 17 is a composite side and sectional view of the ski and ski pole carrying assembly 30 when that assembly is in its compacted nested position of parts; the sectional view portion is taken along section 17A—17A of FIG. 23.

The ski holder assembly base 65 comprises a ski holder assembly base shell 71 (see FIGS. 10 and 18) and a ski holder assembly base cover 72. The base cover 72 is firmly held to shell 71 by front base screw 172 and rear base screw 176. These screws go through the base as shown in FIG. 17 and are firmly held in base screw receivers 177 and 178 in the front and rear support bars 68 and 69 respectively.

Front pivot pin 73 and a rear pivot pin 74 are firmly located in the ski holder assembly base 65 and are pivotally attached to front and rear bearings 85 and 86 in front and rear frame bar members 83 and 84 of the handle assembly 61. The pins 73 and 74 are firmly held between the base shell 71 and the base cover 72. The front and rear pivot pins 73 and 74 are respectively, pivotally held in front and rear journals or pin bearings 85 and 86, respectively.

The base shell comprises a rigid shell chamber 75 contained within the base shell 71, transverse ribs 115, 116 117, 208 and 209 which extend transversely of the shell and a central rib 118 extending longitudinally thereof so that the shell is rigid and forms a rigid truss member between the pins 73 and 74.

The ski holder assembly base 65 also comprises front and rear band support plates 77 and 78 respectively, each of which is a rigid steel plate with formed ends.

Figure 11:
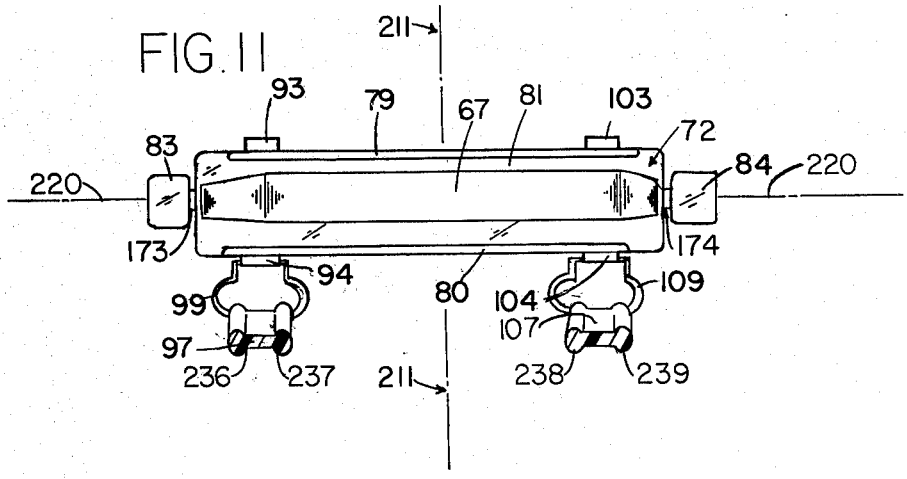
FIG. 11 is a bottom view of parts of assembly 30 in operative condition of that assembly 30 as seen in direction of arrow 11A of FIG. 8.
Figure 12:
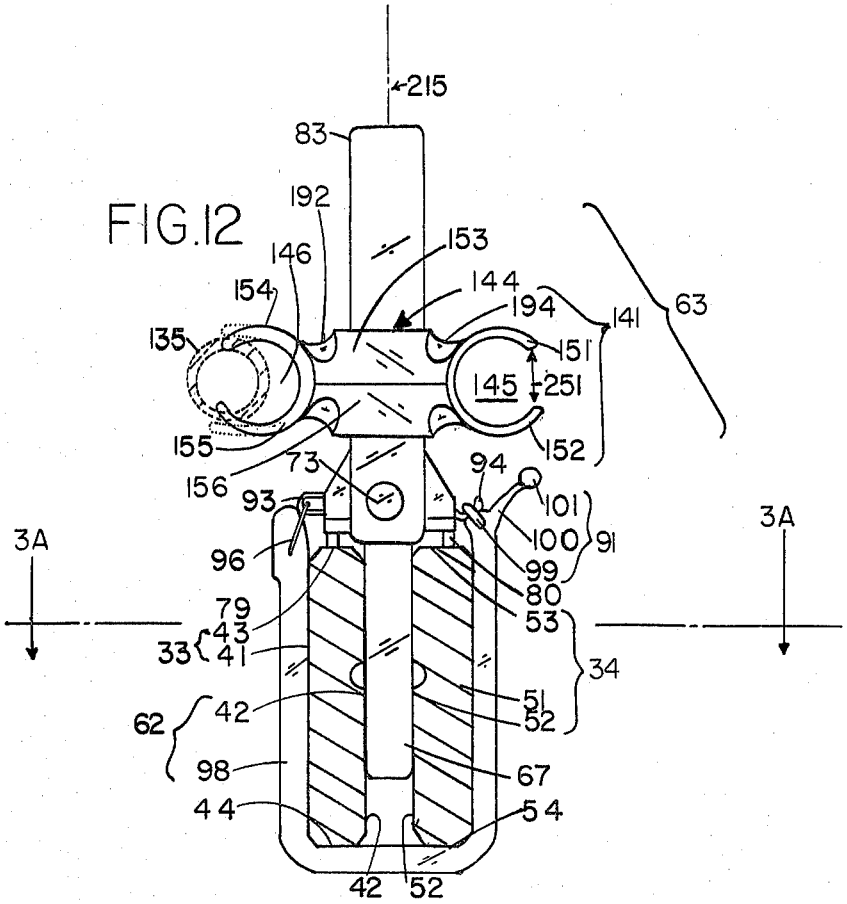
FIG. 12 is a front view of assembly 30 along vertical section 12A—12A of FIG. 7 with ski poles not shown and movable parts shown in dotted lines in different position from their position shown by full lines.

The metallic front band support plate comprises an outer rigid portion 94 formed into a hook 94, a center flat portion 95 which is rigid and is engaged by the base cover 72 and an outer rigid fixed link holder portion 93. The center portion 95 is firmly held in place between the base shell 71 and the base cover 72 and held also in position by a cover screw 172 and is firmly attached to the hook and fixed link holder portions, which latter portions extend laterally beyond the shell, as shown in FIGS. 7, 10, 11, and 18. A rear band support plate 78 is a rigid metal plate like 77 and is held between the shell 71 and cover 72 and comprises a flat center portion 105 (held in place between shell 71 and cover 72 and by screw 176), an outer hook portion 104 and a rear outer link holder portion 103. The hook portions(as 94) of plates 77 and 78 are directed laterally and upwards in the operative position of parts of the ski holder assembly frame 66, as shown in FIGS. 10 and 12, and downward in the compacted position of parts as shown in FIG. 23.

A rear band support plate 78, like plate 77, forms a laterally extending fixed link holder 103 on one side of shell 71 and, on the other side of shell 71, forms an extending hook 104 while its center portion 105 is held by a base screw as 176 which sets in a receiver 178 therefor in arm 84 of frame 66.

The base cover 72 comprises a flat base cover plate 81, a right shoulder 79 and a left cover shoulder 80 that extend lengthwise of the outer surface of the cover along the edges thereof. The outer surface of plate 81 is on the bottom of plate 81 in the operative position of the ski holder assembly frame 66 as shown in FIGS. 10, 11, and 12 but at the top of cover 72 in the nested position of assembly frame 66 as shown in FIGS. 9 and 23.

The plate 81 interior surface has bosses 125 and 126 at its front end for reception of the front band support plate 77 and similar bosses 128 and 129 are provided for the rear band support plate 78. A hole 127 is also provided in the plate 81 for a screw 172 and a similar hole is provided between bosses 128 and 129 for the screw 176. Additional bosses 311, 312, 313 and 314 are provided on the inner surface of the plate 81 to provide for the location of plate 81 with respect to shell 71 but without inhibiting the movement of the central portion of the plate 81 transversely to the direction of the axes of pivot pins 73 and 74.

The structure of pin 73 is the same as pin 74 so the description of pin 73 applies to both. Pin 73 comprises a large diameter head 201 and a cylindrical rigid barrel 202 connected by a narrow neck portion 203 to a wider terminal portion 204 of the pin 73. The portion 204 is the same diameter as the cylindrical portion 202 and is coaxial therewith. In pin 73 a slot 205 extends radially and longitudinally of the barrel 202 for assembly purposes. The neck portion 203 sits in a recess in a rib as 209 like the recess 206 in a transverse rib as 208 located in the shell 71 while the barrel 202 sits in a recess in front end wall 219 like recess 207 provided therefor in the rear end wall 218 of shell 71 of the base 65 of the ski holder assembly 62 and also is rotatably nested in a front bearing or journal as 85: the rear pin 74 sits in recess 207 and rear pin bearing or journal 86. The heads of the pins 73 and 74 each fit rotatably in as recesses 234 and 235 (in the bars 83 and 84) respectively that is longer than the length of the head. In operative position the front and rear end of pins 73 and 74 are level or flush with the outer surface of the bars 83 and 84.

The handle assembly 61 comprises a rigid H-sectioned longitudinal bar 82, a rigid H-sectioned front bar 83 and a rear rigid H-sectioned bar 84. The front bar is firmly attached to the longitudinal bar or handle 82 at the front end of the bar 82 and at the top of the bar 83: the rear bar 84 is firmly attached at its top to the rear end of the longitudinal bar 82. The front bar 83 extends downwardly and forwardly; the rear bar 84 extends downwardly and rearwardly. A front pivot pin bearing 85 is located near the bottom of the front bar 83 and a rear pivot pin bearing or journal 86 is located near the bottom end of the rear bar 84. The bearings 85 and 86 are coaxial with each other and the axis that runs through those bearings is parallel to the length of the longitudinal bar 82. The frame members 82, 83 and 84 are "H" sectioned, each such bar having a top plate as 87, a web as 88, and a bottom plate as 89 as shown in FIG. 10.

The bars 82, 83 and 84 surround a handle enclosure space 90: the ski pole holder assembly 63 is located in space 90 in the compacted nested carried position of parts shown in FIG. 9.

Each of bands 91 and 102 is a flexible elastically extensible strap of rubber that is uniform and rectangular in trannsverse cross-section and beaded at its edges.

Front band 91 has a permanently held end 97 which is held by a fixed link 96 to link holder 93 and connected in series with a loop portion 98 which is flexible and resiliently extensible, at the other end of which is a movable releasable rigid metal link 99 and, also, a free end tab 100 which projects beyond the attachhment of the movable link 99 (see FIG. 12) and an enlarged end or lip 101 is provided at the outer end of tab 100 to facilitate manipulation thereof. Hook 94 engages the movable link 99 attached to the front band 91 (as shown in FIGS. 12 and 9).

Figure 7:
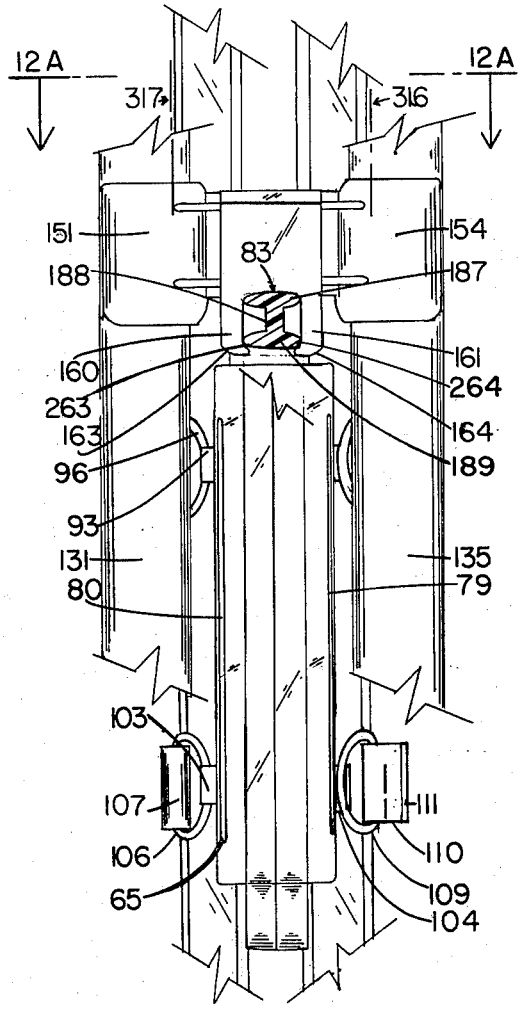
FIG. 7 is an enlarged top view of zone 7A of FIG. 6 with parts shown broken away along the broken section planes 7B—7C—7D of FIG. 8.

A permanently attached rear band link 106 is attached to the rear fixed band link holder 103 for the rear band 102. The rear band 102 has a held end 107 which is attached to the permanently attached link 106, a loop portion 108 connected to the held end and a free or movable link 109, a free end tab 110 and a free end lip 111. The movable link 109 is firmly held to the loop portion 108 and the free end tab 110 extends beyond the link to an end tab or lip 111. In the operating position of the apparatus the link 109 engages the hook 104 and is positioned by the operator holding the tab 110 as shown in FIG. 7.

The pole holder assembly 63 comprises, in operative combination, a left ski pole holder unit 141, a right ski pole holder unit 142, a handle holder unit 143, and a ski pole holder assembly core 144. The left ski pole holder unit 141 encloses a left ski pole holder enclosure 145; the right ski pole holder encloses a right ski pole holder unit enclosure 146; and the handle holder unit 143 encloses a handle holder enclosure 147.

Figure 14:
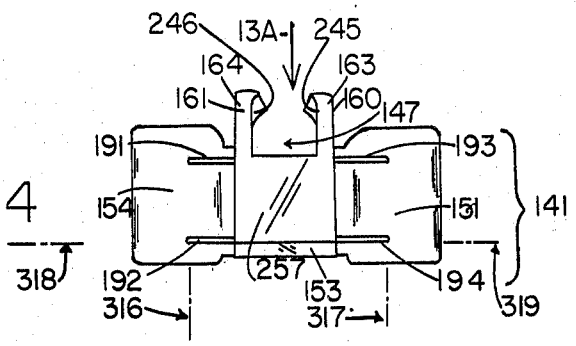
FIG. 14 is a top view of the pole holder assembly 63 as seen along the direction of the arrow 14A of FIG. 13.
Figure 15:
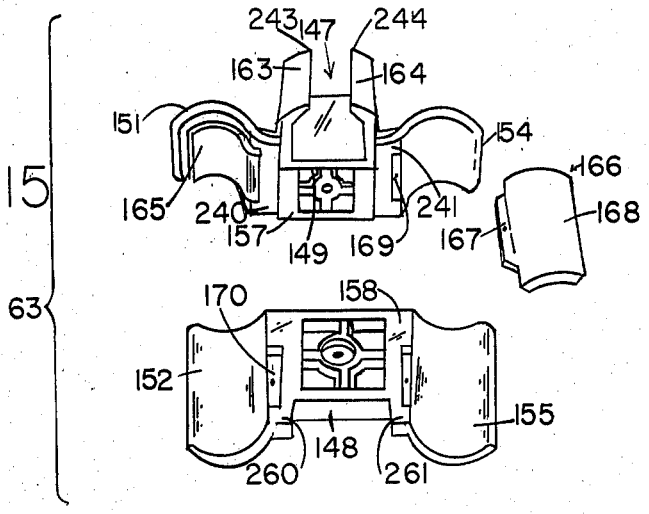
FIG. 15 is an exploded view of parts of the pole holder assembly 63 with adjustment shims 165 and 166. This figure shows the interior portions of the upper and lower ski pole holder assembly portions 157 and 158.
Figure 16:
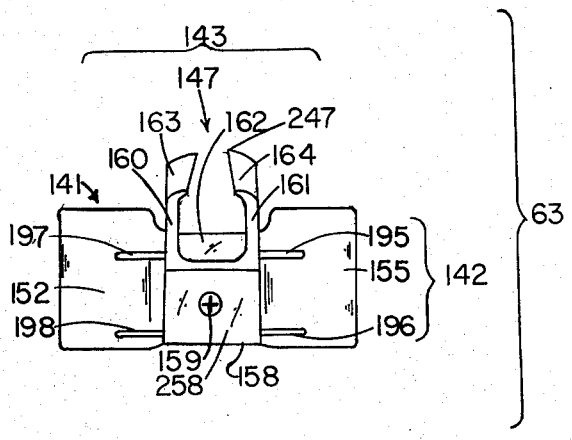
FIG. 16 is a view from the bottom of the pole holder assembly 63.

The left ski pole holder unit, 141, comprises a left pole holder top curved arm 151 and a left pole unit bottom curved arm 152 as shown in FIGS. 14, 15 and 16.

The right pole holder unit 142 comprises a top curved arm 154 and a bottom curved arm 155. These arms are sectors of a cylinder and extend for a total arc of 280° around the cylindrical enclosure 146. They are flexible at their outer or free edges and are provided with ribbing elements 191 and 192, respectively, at the top right rear and front of arm 154; the left top arm 151 is provided with a rear rib 193 and a front rib 194. Similarly, the bottom left arm 152 is provided with a front right arm rib 196 and a rear right arm rib 195 and a bottom left arm 152 is provided with a rear rib arm 197 and a front rib arm 198. For manufacturing purposes the ski pole holder assembly core 144 is formed of an upper or top core unit 157 and a bottom core unit 158 and is rigid. The top portion 157 of the core and the bottom portion 158 of the core 144 are firmly held together by a core screw 159. The bottom portion 158 of the core 144 is firmly attached to the left and right pole holder unit bottom curved arms 152 and 155; the top portion of the core 144 is firmly attached to the right pole holder unit top curved arm 154 and the left pole holder unit top curved arm 151 and, also, the handle holder unit 143.

The handle holder unit 143 comprises a handle holder unit left arm plate 160, which is a flat vertically extending rigid plate, and a corresponding mirror-image right arm plate 161. The plates 160 and 161 extend rearwardly from and are firmly attached to the rear face of the core, 162 (see FIG. 14). A left plate ledge 163 is firmly attached to and extends inwardly or centrally from the left handle holder unit arm plate 160 and a right plate ledge 164 is firmly attached to and extends centrally or inwardly from the right handle holder unit arm plate 161 as shown in FIGS. 13, 14, 15 and 16. The arm plates 160 and 161, face 162 and the ledges 163 and 164 serve to define the handle plate enclosure 147. In operation, as shown in FIG. 7, the front bar 83 of the handle assembly 61 is located within the handle space or enclosure 147.

An adjustment shim as right adjustment shim 166 and a like left adjustment shim 165 are held within the left pole holder unit 141 and right pole holder unit 142 respectively. These shims are mirror images of each other so that the description of the right adjustment shim applies also to the structure of the left adjustment shim. The right adjustment shim 166 comprises a curved plate 168 which is firmly attached to a rectangular key 177. The key 167 fits into a hole 169 in the core 144 (such as hole 169 on the right hand side of the core 144 for the key 167) and a like hole 170 is provided on the left side of the core for the key of the shim 165.

Figure 13:
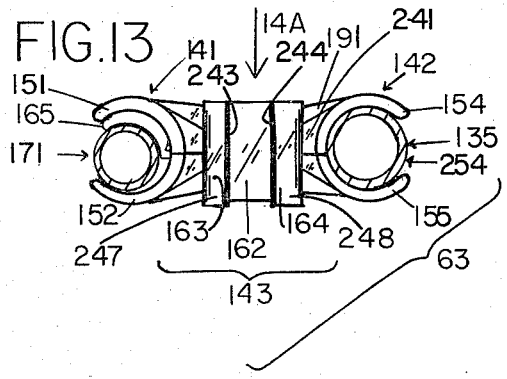
FIG. 13 is a rear view of the pole holder assembly 63 as seen along the direction of arrow 13A of FIG. 14.

The shims 165 and 166, with the other parts of assembly 63, provide for holding a smaller ski pole i.e. 1 cm. or ⅜ inch diameter as 170, shown in FIG. 13 instead of the larger ski pole 135 as shown held in the enclosure 145 in FIG. 13.

Figure 8:
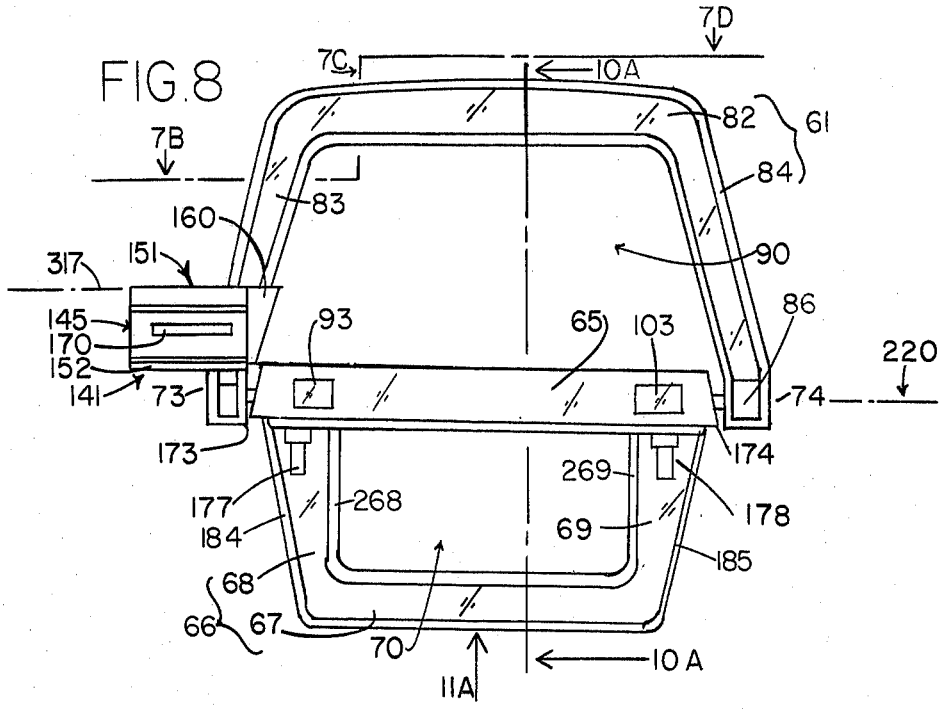
FIG. 8 is a side view, enlarged to the same scale as shown in FIG. 9, of zone 8A of FIG. 1 showing the relationship of parts of assembly 30 during its operative condition shown in FIGS. 1, 2 and 4–7.

The bottom ends of handle assembly front and rear bars 83 and 84 have a sufficient degree of resilient flexibility to be resiliently extended frontwardly and rearwardly along length of the axis of pins 73 and 74 so that the space 173 between the front bar 83 and the ski holder assembly base 65 may be readily extended by movement of ledges 163 and 164 into the space 173 sufficiently for the left and right ledge plates 163 and 164 to be easily passed upwardly, while the arms 160 and 161 engage the sides of arm 83, from below the lower end of arm 83 in the position of parts shown in FIG. 8 to a position whereat the bottom of the pole holder assembly 63 is above the journal 85 of pivot pin 83 as shown in FIGS. 8 and 12. Arm 83 is H-shaped, formed of plates 187 and 189 and web 188. The plates 187 and 189 of the bar 83 of the handle assembly 61 are elastically distortable at their lateral edges and provide for vibration-free attachment of the handle holder unit 143 to the bar 83 of the handle assembly 61 and accordingly provide for a firm attachment of the unit 143 to the handle arm or bar 83.

In operation or use of the apparatus 30 as shown in FIGS. 1–4 the ski holder assembly 30 serves to hold a ski 33 on the left hand side thereof and another ski 34 on the right hand side thereof; links 99 and 109 then engage hooks 94 and 104 respectively and skis 33 and 34 are then held by the resilient bands 91 and 102 which press the bottom surfaces of the skis against the frame assembly 67 while the ski pole assemblies are held by the pole holder assemblies 63 (also referred to as the ski pole holder).

The left ski pole assembly 35 comprises a pole 31 usually about 4 feet long and $\frac{5}{8}$ inch in diameter, a loop or wrist strap 132 at its upper end and a wheel or ring 133 near to its point or lower end. The right ski pole assembly 36 comprises a like 4 foot long $\frac{5}{8}$ inch diameter rigid bamboo or metal pole with a wrist strap 136 at its upper end and a reel 137 at its lower end near its point. These assemblies are held, as shown in FIGS. 1, 5, 6, 7 and 13 by engagement of the pole holder assembly 63 with the pole portion of each of these ski pole assemblies.

The skis 33 and 34 are downhill skis for purpose of illustration but could be jumping or cross country skis. The downhill skis are usually about 7 feet long (213 cm) and 3 inches wide (7.6 cm) have a center groove and steel edges to bite into undersurface. The jumping skis are about 8 feet long (244 cm) and wider and thicker and have 3 grooves in the side. Cross country skis are narrower and lighter, with no metal edges.

Figure 3:
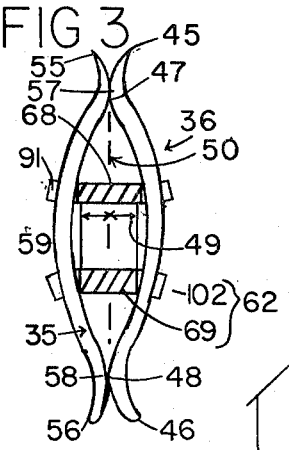
FIG. 3 is a diagrammatic sectional view of the skis 33 and 34 and portions of ski holder assembly 30 as seen along section 3A—3A of FIG. 12.
Figure 4:
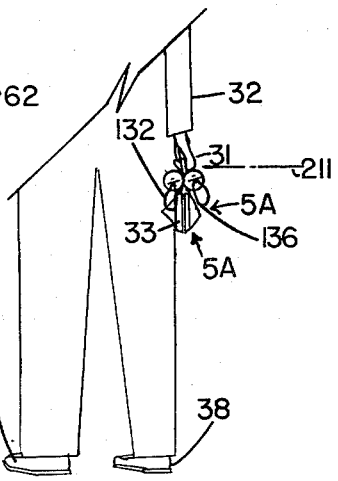
FIG. 4 is a rear view of the apparatus and operator shown in zone 4A of FIG. 1.
Figure 5:
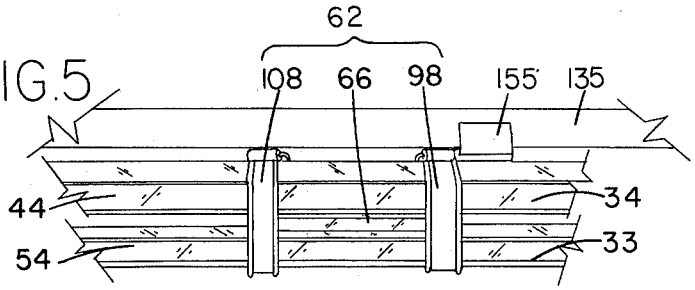
FIG. 5 is a bottom oblique view showing the skis and a ski pole held by the apparatus 30 as seen along the direction of arrow 5A of FIG. 4.
Figure 6:
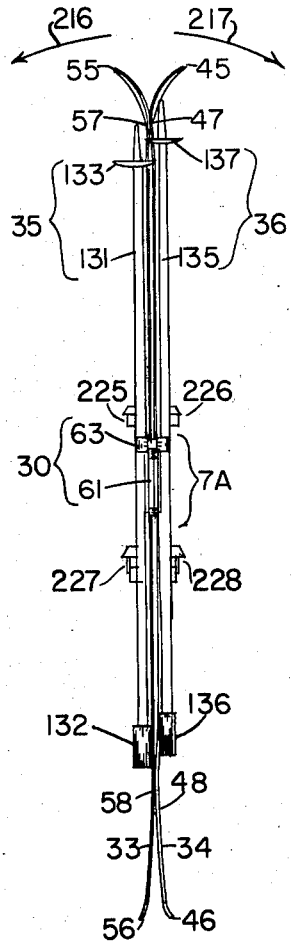
FIG. 6 is an overall top view of the skis and ski poles and apparatus 30 held by operator 32 in FIG. 1 as seen in direction of arrow 6A of FIG. 1.

As shown in FIGS. 1, 2, 4–7 and 12 the right hand ski 34 has its usual top surface held by the assembly 30 to face rightwards. The bottom surface or sole as 42 of one the skis as 34 is held within the ski holder assembly 62 and contacts the bottom surface or sole as 52 of the other ski as 33 at, respectively, the front and rear contact points 47 and 48 of the right hand ski and the front and rear contact points 57 and 58 of the left hand ski 34 (as shown in FIGS. 3 and 6). The operating right side edge 44 of the right ski 34 is located and shown at the bottom of the ski holder assembly 62 and the operating left side edge 43 of the right ski 34 is held upward thereof as shown in FIG. 12. The top surface 51 of the left ski 33 is held on the left hand side of the ski holder assembly 62 in the carrying position of the skis as shown in FIGS. 1–4, and faces toward the operator as shown in FIG. 4 while the bottom surface or sole 52 of the left hand ski 33 faces outward and contacts the bottom surface 42 of the right hand ski at the front contact point 57 and rear contact point 58 of the left hand ski. The operating right side edge 53 of the left hand ski is located above the operating left side edge 54, as shown in FIG. 12. The front end or tip 55 of the left hand ski and rear or heel end 56 of the left hand ski 33 are firmly held in fixed relation to the front end 45 and rear end 46 of the right hand ski 34 respectively by the ski holder assembly 62 during the carriage of such pair of skis and a pair of ski pole assemblies as 35 and 36 by the ski and ski pole carrying assembly 30 as shown in FIGS. 1–7. The skis 33 and 34 and ski pole assemblies 35 and 36 are held in a readily controlled and stable manner by the assembly 30 in the operator's hand as 31 between the waist 39 and feet 37 and 38 of the operator 32, generally at about the level of the knee.

The normal camber or arch of the skis and the holding of the skis by assembly 62 provides that a straight line, the chordal line 50, extends between the front contact zones 47 and 57 of the left and right hand skis 33 and 34, respectively, to the rear contact zones 48 and 58 of the skis 33 and 34. The zones 47, 48, 57 and 58 are those vertically extending narrow rectangular surfaces where the curved surfaces of the skis are tangent to each other; such zones are small in area and substantially linear but do provide such an effective frictional connection therebetween as to so fixedly locate those ski surfaces and skis relative to each other that the skis do not move relative to each other during while held and transported by the assembly 30 in its operative position.

The distance from the chordal line 50 (measured transversely to such chordal line) in the zone between bands 91 and 102 of the ski holder assembly 62 to the sole or bottom surface 42 of the right hand ski, which distance is shown as 49 in FIG. 3, plus distance 59 from such chordal line 50 to the bottom surface 52 of the left hand ski 35 is the total chordal radial distance. The bands 91 and 102 of the ski holder assembly 62 firmly grip the skis and press them together so that the front contact zones 47 and 57 and the rear contact zones 48 and 58 develop and provide, thereby, a firm connection therebetween due to the pressure applied thereto by the bands 91 and 102: because, also, of the dimensional stability of the ski holder assembly frame 66, the zones of contact of the bottom surfaces of the skis do not shift during carriage of the skis 33 and 34 by the ski and ski pole carrying assembly 30.

The bands 91 and 102 are each alike in size, extensibility and transverse cross-section. The transverse cross-section of each, as shown in FIG. 11, provides beading or ridges as 236 and 237 on the edges of band 97 and beading 238 and 239 on band 107 so that the stretching of the bands around the bodies of the skis, as shown in FIG. 12, provides a positive non-slipping engagement of such expanded beads and remainder of bands with the surfaces of the skis contacted thereby and serves to firmly hold such skis in position against shifting along the direction of the length of the ski relative to each other and relative to the ski holder assembly 62 as well as holding the skis firmly against the ski holder assembly frame 66.

The ledges 163 and 164 of the ski pole assembly 63 are, as shown in FIGS. 14, 15 and 16, tapered toward their central edges 243 and 244, and the interior surfaces 245 and 246 of the ledges 163 and 164, respectively, match the size and shape of the outer edges, 263 and 264 of the central plate 189 of "H" shaped bar 83 of handle assembly 61.

While stable longitudinally and against transverse stress, the plate elements 187 and 189 are elastically compressible and distortable along their lateral edges as 263 and 264 to accommodate with a sliding fit to the ledges 163 and 164 of arms 160 and 161 of the pole holding assembly 63 and so develop a smooth firm fit and connection to the core and pole holding arms of the pole holder assembly 63.

In the expanded ski and pole-carrying operative array of member assemblies 61, 62 and 63 of assembly 30, the pole assemblies 35 and 36 are held in the arms of the pole holder assembly 63 at about the center of gravity of each pole assembly. The wheels of the ski pole assemblies then contact the upper (as shown in FIGS. 1, 2, 6 and 12) portions of the straight portion of the skis and prevent the rotation of such skis about the horizontal longitudinal axis 220 (shown in FIGS. 8 and 11), which axis is parallel to the central longitudinal axis of pins 73 and 74, in the clockwise direction 221 or counterclockwise direction 222. In the expanded ski and pole carrying operative array of assemblies 61, 62 and 63 of assembly 30, the skis 33 and 34 are held by bands 91 and 102 as shown in FIGS. 1 and 6 near the center of gravity of such skis and between the left front binding element 225 and the left rear binding element 227 and between the right front binding element 226 and the right rear binding element 228 on the left and right skis 33 and 34 respectively. In such array of skis, poles and assembly 30, as elastically extended bands 91 and 102 hold the skis firmly together not only adjacent to the ski holder assembly frame 66 but also at the contact zones 47, 48, 57 and 58, the positive rigid connection of the arms 83 and 84 of handle assembly 61 to the arm 82 of handle assembly 61 and the fixed position of the axis of pins 73 and 74 and the fixed position of base 65 and frame 66 hold the skis in alignment with the length of handle bar 82. Additionally, the rings of the ski poles engage the ski edges and utilize the rigidity of the combination of frictionally engaged pair of skis in a vertical plane and a horizontal plane passing through the zones of contact 47, 57, 48, 58 and enhance the ability of the operator to positively position the ski poles through the handle assembly 31, so that the control of the pivotal movements of the ski pole assemblies 35 and 36 is assisted by the contact of the ski poles with the skis, which are engaged therewith.

The material of the "H" section of which the arm 83 of handle assembly 61 is formed allows some elastic deformation of the central plate 189 thereof by the ledges 163 and 164 of the side plates 160 and 161 of the pole holding assembly 63 and so improves the firmness of the fit therebetween and eliminates rattle of the ski pole holding assembly relative to handle assembly 61 and vibration of the ski poles to help provide positive control of the position of the ski poles by the positioning of the handle assembly 61 in the operative expanded position of the assembly 30 (shown in FIGS. 1–7). Also, in the operative position of the assembly 30, the bands 91 and 102 and base 65 and frame assembly 66 which hold the skis and the handle assembly 61 are firmly yet resiliently held in fixed relationship to the length of the skis, generally as shown in FIGS. 3 and 6. Such positioning provides that there is no oscillation or shifting of the handle assembly 61 along the length of the skis while the skis are supported by the assembly 30 and carried by the operator 32. As the frame members 67, 68 and 69 act as a spacer between the curved soles of the skis and the bands hold the skis resiliently during use of the assembly 30 to support the skis and poles, the combination of ski holder and skis is rattle-free as it avoids an unyielding contact of only rigid solid structures with the relatively rigid ski bodies. In this operative position, also, the longitudinally firm connection of the ski support assembly 62 to handle assembly 61 allows manipulation of the skis by the operator 30 around the vertical axis 215 (shown in FIGS. 1 and 10) so as to control positive movement of the front and rear ends of the skis to left (direction 216) or right (direction 217) as shown in FIG. 6 as well as positive control of the upward movement (212) and downward movement (213) of the front end of the skis and corresponding movement of the heel or rear end of the skis about the horizontal transverse axis 211 (shown in FIGS. 4, 10 and 11) and like pole movement.

The clockwise rotation (direction 221, FIG. 2) and counterclockwise rotation (222 shown in FIGS. 2 and 4) permitted (by the connection of pins 73 and 74 with handle assembly 61) to pole carrying assembly 62 in assembly 30 by itself is limited by the coaction of skis, poles and assembly 30 in the operative arrangement of ski poles, skis and assembly 30, as in FIGS. 1–7, because the ski pole holder assembly 62 serves to hold the skis and ski poles and the firmly held skis help support the ski poles and prevent their wobbling; at the same time the ski poles contact the skis and prevent their rotation about the horizontal longitudinal axis 220 through the pins 73 and 74. Thereby, while the assemblies 62 and 63 of the assembly 30 are pivotable about the axes of the pins 73 and 74 when not connected to the skis and poles for the purpose of forming a pocket-sized compact nested apparatus, when the assembly 30 is in its expanded ski-pole and ski carrying arrangement of parts and with poles and skis connected thereto, as in FIGS. 1–7, the result is a sufficiently firm structure that the skis are reliably and easily positioned by one hand 31 of an operator 32 through the handle assembly 61 even about the longitudinal horizontal axis 220. As shown in FIGS. 7, 8, 12, 13, 23 and 24, the shape of the space within each of enclosures 145 and 146 is cylindrical and the longitudinal axis of each of such cylindrical shapes is parallel to axis 220, but lateral and thereabove and rear flat core wall 162 and ledge edges 243 and 244 extend at the same angle (75 degrees in the embodiment shown) to the central longitudinal axes of the cylindrical spaces 145 and 146 as the angle of arm 83 to axis 220.

Figure 2:
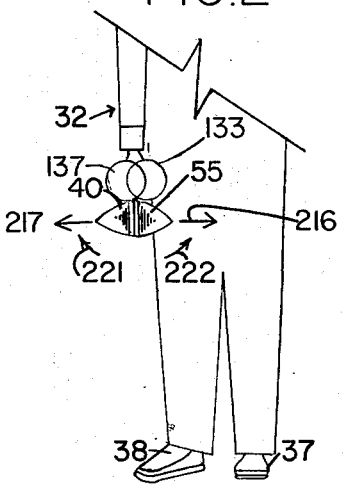
FIG. 2 is a front view of the apparatus and operator 32 shown in zone 2A of FIG. 1.

In the operative position of skis, ski poles and assembly 30, the poles 131 and 135 of the ski pole assemblies 35 and 36, respectively, are held by the arms 151–154 of the ski pole holding assembly 63 so that, at the front end of the skis (as shown in FIGS. 1, 2 and 6) the poles are lateral of and above the top edge of the skis and the rings of the pole assemblies press against the top left edge of the left ski and the top right edge of the right ski, whereby the skis press the rings apart and upward, whereby rotation of the skis about the axis 220 is inhibited by the contact of the outer upper edges (as shown in FIGS. 2 and 12) of the skis with the ski pole rings or wheels 133 and 137. The assembly 63 is locatable on the arm 83 of handle assembly 61 to provide vertical location of the ski poles to provide application of the weight of the front (as viewed in FIG. 1) portion of the poles on the skis and the resilient force developed thereby as needed for such purpose.

Figure 24:
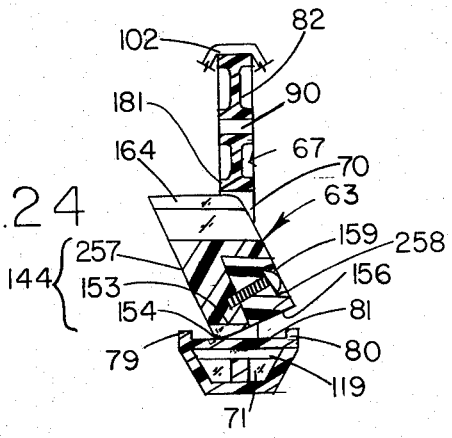
FIG. 24 is a sectional view of portions of the ski and ski pole carrying assembly 30 during stages of its assembly and/or disassembly as viewed along Section 23A—23A of FIG. 9.

As shown in FIGS. 23 and 24 the base cover 72, which comprises the base cover plate 81 and the shoulders 79 and 80, is held at its edges to the shell 65. However, as particularly shown in FIG. 10, the transverse ribs 115, 116 and 117 208 and 209 (shown in FIGS. 17 and 18) and longitudinal rib 118 do not extend up to or contact the interior surface of plate 81; instead, a space 119 is provided between the top of such ribs and the bottom of plate 81. Accordingly (as shown) in FIG. 24) there is an available resilient deformation of the plate 81 when the upper portion (in FIG. 24) of the ski pole holder assembly 63 is tilted and pressed to be moved out (leftward in FIG. 24) from or inwards (right in FIG. 24) under the arm 67 of assembly 66. The ledges 79 and 80 prevent movement of the assembly 63 from the enclosure 70 in the frame assembly 66 until such deformation of the flat plate 81 is achieved unless the arms 154 and 151 of the assembly 63 earlier deform to permit movement of assembly 63 into or out of the enclosure space 70.

Figure 18:
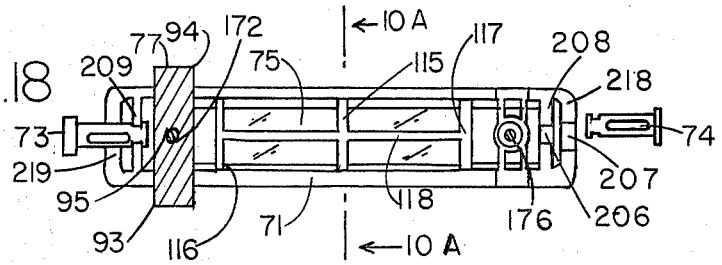
FIG. 18 shows the ski holder base shell 71 as seen from the top when disassembled from its cover and with band support plate 77 in its position when assembled.
Figure 19:
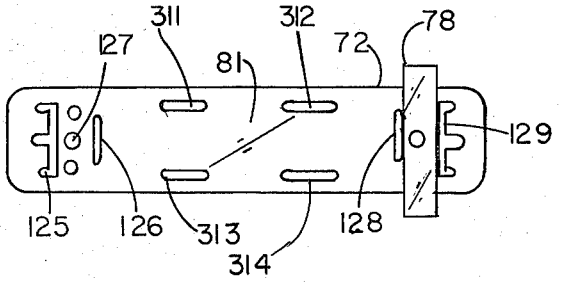
FIG. 19 shows the cover 72 of the base 65 of the ski holder assembly 62 as seen from its interior and also shows the location thereon of a rear band support plate 78.
Figure 20:
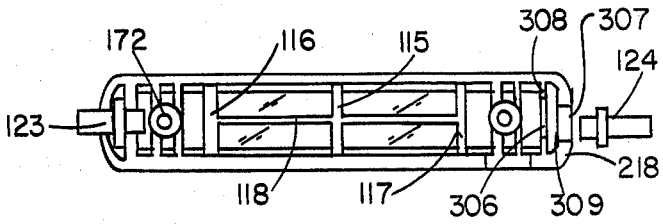
FIG. 20 shows a top view of another embodiment of the shell 71 with its cover removed and with a different style pin 124 therefor than in FIG. 18.
Figure 21:
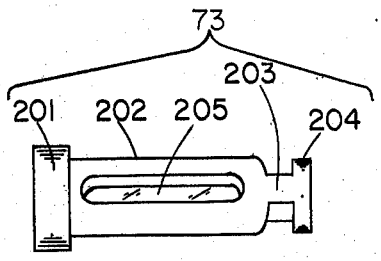
FIG. 21 shows a side view of the pivotal support pin 73, used in the embodiment of shell shown in FIG. 18.
Figure 22:
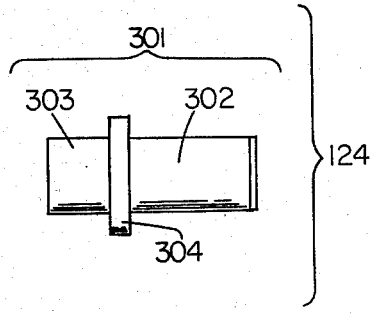
FIG. 22 shows a side view of the embodiment of pivotal support pin 123 as is used in the shell shown in FIG. 20.

In the embodiment of shell and pivot pins shown in FIGS. 20 and 22, the pivot pins 123 and 124 are used in place of the pivot pins 73 and 74 in the embodiment shown in FIG. 18. In the embodiment shown in FIGS. 20 and 22 these pivot pins, as shown for 124, comprise a rigid solid cylindrical barrel 301, and a rigid annular collar 304. The front end, 303, of the barrel pivotally sits in a recess 306 in a transverse rib 308 in the shell 71 while the rear or outer portion of the pin 124 pivotally sits in a recess 307 in the outer shell wall 218 and a portion of the outer or rear barrel 302 projects beyond the shell 71 and pivotally engages a rear bearing or journal as 86 in the rear arm 84 of the handle assembly 61. The front bearing pivot pin 123 is correspondingly formed and pivotally sits in a front journal as 85 in the front arm 83 of the handle assembly 61. The collar at 304 on the pin 123 sits and is pivotally held in a recess 309 between the transverse rib 308 and the rear wall 218 of the shell 71. This structure provides for pivotal motion of the base 65 of the pole holder assembly 62 relative to the handle assembly 61 but allows a simpler structure of the journals 85 and 86 in the arms 83 and 84 in the ski holder assembly base 65 and permits longitudinal extension of the journals 85 and 86 relative to the base 65 to permit the ledges 163 and 164 of the ski pole holder unit 63 to pass between the base 65 and an arm as 83 of the handle assembly.

The central portions 189 and 190 of the bars 83 and 84 respectively, are at an angle of 75 degrees, in the particular embodiment shown, to the longitudinal axis 220 passing through the central longitudinal axes of pivot pins 73 and 74, and to the top longitudinal bar 82 of handle bar 61 as shown in FIGS. 8 and 17.

The peripheral plates 184 and 185 of the H-sectioned bars or arm 68 and 69 of ski holder assembly frame 66 are at an angle of 75 degrees in the particular embodiment shown, to the longitudinal axis 220. The central plates 268 and 269 of the H-sectioned bars or arms 68 and 69 respectively are at an angle of 90° to the longitudinal axis 22. The peripheral or outer plates (outer relative to enclosure 170) 184 and 185 of bars or arms 68 and 69 are continuous with outer or peripheral plate portions 183 of arm or bar 67 of frame 66. The central or inner (relative to enclosure 70) plate portions 268 and 269 are continuous with inner or central plate portion 181 of bar or arm 67.

The side to side distance from the left lateral edge of arms 151 and 152 to the right lateral edge of arms 154 and 155 (as shown in FIGS. 13 and 16) is slightly less than the front to rear (as shown in FIGS. 8 and 17) distance across the ski holder assembly enclosure space 70 between the central edges 268 and 269 of arms 68 and 69 of ski holder assembly frame 62.

As shown in FIG. 12 the top to bottom distance of pole holder assembly 63 from top edge of top pole holding unit arms 151 and 154 to bottom edges of arms 152 and 155 is the same as the top to bottom distance of the core 144. The front to rear distance, as shown in FIG. 8, from the front edge of arms 151 and 154 to the top rear edge 247 of the ledges 163 and 164 at the top (as shown in FIGS. 7 and 8) of the assembly 63 is greater than the distance from the front edge 156 of the core to the rear edge as 248 at the bottom (as shown in FIGS. 8 and 13) of ledge 164. Such slant compensates for the slant (relative to axis 220) of the handle bar 83 to which handle holder unit plates 160 and 161 and ledges 163 and 164 are attached.

To bring the assembly 30 from its expanded ski and ski pole holding array of parts shown in FIGS. 1–7 to its nested, compacted position of parts shown in FIG. 9 the bands 91 and 102 are loosened from their attachment to the hooks 904 and 104, and the skis, usually on the ground, separated from the ski holder assembly 62. The ski pole holder assembly 63 is then slid downward from its position shown in FIG. 8 and separated thereby from the arm or bar 83. The ski holder assembly 62 is then pivoted relative to frame assembly 61 around the axis of pins 73 and 74 after the pole holding assembly 63 has been separated from the arm as 83 of handle assembly 61. The arms 67, 68 and 69 of the ski holder assembly frame may then be positioned within the handle enclosure space 90 as shown in FIGS. 9 and 17.

The pole holding assembly 63 is then locatable within the ski holder assembly frame enclosure space 70.

The space between the ledges 79 and 80 on base cover plate 81 is greater in transverse distance across plate 81 than the height of the core assembly 144 and/or the height measured from the bottom of 155 (or 152) to the top of the arm 154 (or 151). Therefore, the assembly 63 snugly fits between the ledges 79 and 80 when in position as shown in FIGS. 9 and 23.

The distance from the rear upper edge 247 of ledge 164 on the right side of assembly 63 to the front edge of right arm 154 is greater than the distance from the top (as shown in FIG. 9) of cover plate 81 to the bottom of the inner plate 181 of arm 67 as shown in FIGS. 23 and 24. The distance from the top of plate 81 to the bottom of plate 181 is, however, greater than the distance from the bottom front edge 248 of ledge 164 to the front of right arm 155 and also to the front lower core face 156. The ledges 163 and 164 are also bevelled near to and are rounded at their lower edges, as 248 on ledge 164 and 249 on ledge 163, so as to assist in prying the distortable plate 181 and distortable arms 151 and 154 during entry of the assembly 63 into the ski holding assembly enclosure space 70.

The front face of the core 144 has an upper backward slanted face portion 153 and a lower face portion 156 which is perpendicular to the longitudinal central axis of the cylindrical cavities as 145 and 146. The resilient arms 151 and 154 extend forward of the top end of the face 156 (as shown in FIG. 14) and provide for an elastic bending of the arms inwards to cavity 145 and 146 when the top front edges of arms 154 and 151 of assembly 63 are pressed against the top surface of cover plate 81 while surface 153 is parallel to the top of base cover plate 81 (as shown in FIG. 24) and so compressing arms 154 and 151 against the top (as in FIG. 24) surface of cover plate 81 while pivoting the assembly 63 in the clockwise direction as shown in FIG.24; when such pressing and pivoting are complete, such actions bring the face 156 in direct contact with the top surface of cover plate 81. Cover plate 81 is also elastically deformed in this process and the assembly 63 is thereby located between the ledges 79 and 80 on plate 81, but, absent pressure from the right (as shown in FIGS. 23 and 24) side the ledges 163 and 164 are in contact with the inner plate 181 of the H-sectioned arm 67 and remain securely in the ski holder assembly space 70 until forced sideward and downwardly sufficiently forcefully to overcome the resiliency of the arms 154 and 151: merely pushing the assembly 63 sideward along surface 81 transverse to the length of the cover does not cause removal of the assembly 63 because the effect of such movement is only that, thereby, arms 154 and 151 engage one ledge, as 79 of the base cover 72, or the arms 152 and 155 merely engage the other ledge 80, on such transverse movement of the assembly 63 along the top surface of cover plate 81 but do not move past such ledges. To effect release of the assembly 63, the assembly must be firmly pressed downwards against the top surface of cover plate 81 after pivoting of assembly 63 so that it is pivoted in the counterclockwise (as shown in FIG. 24) direction sufficient to bring the bottom rear edges 247 and 248 of the ledges 163 and 164 into contact with the inner plate 181 of the arm 67 of assembly 62. Only after such pivotal positioning of the assembly 63 is pressure on assembly 63 to elastically compress or bend the arms 154 and 151 in a radical direction toward the center of enclosure 145 and 146 effective to permit release of the assembly 63 for further counterclockwise (as shown in FIG. 24) motion and movement outward of the assembly 63 from the enclosure space 70.

This snap like but positive holding action of the assembly 62 on the ski pole holding assembly 63 permits the straps 91 and 102 to be loosened and disconnected from hooks 94 and 104 when the assembly 30 is in its nested arrangement of parts, as in FIG. 9, for purpose of rearrangement of such parts to the expanded arrangement thereof (shown in FIGS. 8 and 12) without loss or mislaying of the assembly 63, as the resiliently distortable co-acting members of the ski pole holder assembly 63 and the ski support frame 66 securely yet releasably hold the ski pole holder assembly in the frame 66.

The single position of location and attachment of the ski and ski pole holder assembly 30 relative to the skis 33 and 34 and ski pole assemblies 35 and 36 provides that the operator-porter-skier 32 may readily assemble the array of ski and ski pole holder assembly 30, skis 33 and 34 and ski poles as 35 and 36 without requirement of making connections of the holder assembly 30 to portions of the skis and poles that are far apart.

The total chordal distance (50+59) is less than the usual camber or arch of the skis. When the skis are held in the assembly 30 as shown in FIGS. 1–7 such chordal distance is the distance across ski holder assembly frame bars or arms 68 and 69 measured transversely to the length of longitudinally extending arm or bar 67 and vertically extending bars 68 and 69. The bars or arms 67, 68 and 69 are spacer arms because they maintain the space across the soles of the skis. Also, being firmly connected to each other and to the base 65 and, via the rigid pivotal pins 73 and 74 connected to arms 83 and 84, the components of assembly 62 prevent motion of the base 65 in directions except those parallel to the length of the longitudinal axis 220 and, therefore, serve to control orientation about axis 215 of the length of the skis held by assembly 30 relative to the length of the longitudinally extending arm or bar 82 of handle assembly 61. Also, the firm connection of the skis held by bands 91 and 102 of assembly 30 against the straight rigid ledges 79 and 80 of cover plate 72 of base 65 and the connection of base 65 to arms 83 and 84 provide for positive orientation by the handle assembly 61 about the horizontal transverse axis 211 of the skis and ski poles held by assembly 30.

In the compacted position of parts of the assembly 30, shown in FIG. 9, the tabs 100 and 110 extend over and lateral of the hooks 94 and 104 and hence protect the pockets of the operator-porter, or skier 32 from being snagged or otherwise damaged by such hook elements as well as preventing damage to such elements by impact thereagainst while carried by the operator, porter or skier 32. In the compacted position of parts shown in FIG. 9 the narrow edges of the pole carrying assembly, i.e. the lateral (as shown in FIG. 12) edges of arms 151–154 and edges of ledges as 163 and 164 are protected by the straps 91 and 102 as well as by the frame assembly 66 and handle assembly 61 against damage thereto by impact therewith and the wearer is also protected by damage therefrom by impact therefrom.

The ribs as 191–198 are spaced sufficiently from the front and rear edges of the arms as 151–154 so that the flexibility of the material of which the arms 151–154 are made not only allows the arms to open by pivoting about the longitudinal arm axis 316 (for left side arms 151 and 152) and longitudinal arm axis 317 (for right side arms 154 and 155) to an expanded position as shown in dotted lines in FIG. 12 to accept the ski poles, as 135, within their cavity as 146, but also, by pivoting about the transverse arm axis 318, the left upper arm 151 and right upper arm 154 resiliently deform, when pressed against the cover plate 81 as shown in FIG. 24, to be moved into the ski holder assembly frame enclosure 70, and thereafter, on expanding, automatically hold securely the assembly 63 within the structures, as shoulders 79 and 80, and arms 67, 68 and 69, which outline the enclosure 70.

The weight of the ski pole holder assembly 63 is only 1½ ounce (42 grams) with range of one to two ounces. However, the force needed to be applied to the arms 154 and 151 of assembly 63 to displace them from their normal or resting shape and position, shown in FIGS. 8 and 23, in which position the internal surfaces of arms 154 and 151 outline sectors of a cylinder, to a resiliently distorted elliptical shape that permits the unit 63 to be placed within the enclosure 70—and which force is also required to permit removal of the assembly 63 from the enclosure 70—is about 3 pounds, and usually between 1½ to 5 pounds. Such force is far in excess of the weight of the assembly 63 although well within the capacity of the usual skier to apply. Accordingly, the weight of the assembly 63 is entirely inadequate to cause release thereof from the enclosure 70 once placed therein. Assembly 63 is securely held in enclosure 70 by coaction of the members of the ski holding assembly 62 and the ski pole holding assembly 63 once assembly 63 is in place in the enclosure 70, as shown in FIGS. 23 and 9 until deliberately forcefully removed therefrom by the operator or skier or porter, as 32.

The weight of each of the ski pole assemblies as 35 and 36 is usually only about 12 ounces (340 grams) with range of 10 to 16 ounces. However, the force needed to be applied between arms 154 and 155 and between arms 151 and 152 to displace them from their rest shape and position shown in FIGS. 7, 8, 12 and 13 in solid lines, and in which position the spaces 145 and 146 are cylindrical, to increase the space as 254 between arms 154 and 155 as shown in dotted lines in FIG. 12 to accept the pole as 135 to be held therein, as in FIG. 13, is from five to ten pounds: such force is horizontal and transverse to axis 220 is far in excess of the weight of the ski poles held by the pair of arms as 151 and 152 and pair of arms 154 and 155 although well within the capacity of the usual skier to apply. The weight of the ski poles is entirely inadequate to cause opening of the spaces as 251 between arms 151 and 152 and space 254 between arms 154 and 155 to release the poles once placed within the spaces as 145 and 146 therefor, especially as the weight of the ski pole assemblies is usually applied downwards (downward as in FIG. 8) and downward motion of the pole assemblies relative to assembly 63 is opposed not only by the contact of the ski pole assemblies and the skis that are firmly held to assembly 30 in position of parts shown in FIGS. 1–7 but also by the ribs 191–198 as well as by the resiliency of the remainder of the arms 151–154 lateral of ribs 191–198 and the firm attachment of the ribs and arms to the rigid core 144 and the firm attachment of the core 144 to an arm as 83 of the handle assembly 61 through the handle holder unit 143; accordingly, in position of parts shown in FIGS. 1–7, the ski poles are securely held once placed between the arms of the ski pole holder units 141 and 142 until deliberately and forcefully removed therefrom by the operator (or porter or skier) 32.

In the position of parts shown in FIGS. 8 and 12, the apparatus 30 is mirror-image symmetrical about a vertical plane passing through axes 220 and 215.

The upper left and right core shoulder 240 and 241, respectively, of assembly 63 rigidly and firmly join to and are located between pole holder arms 151 and 154 and top core portion of the top core unit 157; lower left and right core shoulders 260 and 261 rigidly and firmly join to and are located between lower pole holder arms 152 and 155, respectively, and the bottom core portion 158 of the core 144 as shown in FIGS. 15 and 16. The front bottom face 149 of the top core unit 157 slidably engages the rear face 148 of the bottom core unit (see FIGS. 15 and 23). The bottom front core face 149 is also the front edge of the plates 160 and 161 and the front of a rigid panel of which the rear is the rear face 162 of the core adjacent the handle holder enclosure 147.

The lower right and left shoulders 260 and 261 of the bottom core unit 158 have a sliding fit with the lower and lateral portions of the side plates 161 and 160 respectively of the handle engaging unit 147. That fit and alignment of top core unit 157 of core 144 to bottom core unit 158 of core 144 and the attachment of top arms 151 and 154 to the top core unit 157 and the attachment of bottom arms 152 and 155 to bottom core unit 158 and the adjustability of the connecting screw 159 between core parts 157 and 158 provide for adjusting the spacing of the adjacent ski pole holding right side curved arms 151 and 152 and the adjacent left side ski pole holding curved arms 154 and 155 by increasing the spacing between those adjacent arms from the minimum spacing therebetween as is shown in the drawings and table of dimensions herebelow. Such increase permits decrease of the force required for release of poles from and for entry of the ski poles within the ski pole holding enclosures as 145 and 146 or accommodation of larger diameter poles.

In the herebelow Table I the measurements of components are separately expressed in inches and in millimeters, separately measured; due to the inherent range of precision of such measurements, such expression for some of the values in the English system in the table are not exact arithmetic equivalents of the measurement expressed in the metric system.

The weight of assembly 30 inclusive of all of assemblies 61, 62 and 63, is seven ounces (198 grams).

TABLE 1

| DIMENSIONS OF APPARATUS 30 | inches | mm. |
|---|---|---|
| HANDLE ASSEMBLY 61: | | |
| Longitudinal bar 82 | | |
| Side to side width, plate 87 | 19/32 | 15.5 |
| Side to side width, plate 89 | 19/32 | 15.5 |
| Transverse thickness, web 88 | .0143 | 3.7 |
| Top to bottom thickness, plate 87 | 1/8 | 3.3 |
| Top to bottom thickness, plate 89 | 1/8 | 3.3 |

TABLE 1-continued

| DIMENSIONS OF APPARATUS 30 | inches | mm. |
|---|---|---|
| Total height, web 88 plus plates 87 and 89 | 21/32 | 17.5 |
| Length along bar 82 at top of plate 87 where intersected by planes of plate 187 of arm 83 and corresponding plate of arm 84 | 4½ | 115.0 |
| Front bar of arm 83 | | |
| Side to side width, inner plate 189 | 9/16 | 15.2 |
| Front to rear thickness, plate 189 | 1/8 | 3.3 |
| Thickness, web 188 plus plates 187 and 189 | ½ | 12.5 |
| Side to side width, plate 187 | 19/32 | 15.5 |
| Front to rear thickness, plate 187 | 1/8 | 3.3 |
| Thickness across web 188 | 0.143 | 3.7 |
| Enclosure 90 | | |
| Distance across, from arm 83 to arm 84 at top of arms 83 and 84 | 3-15/16 | 100 |
| Distance across, at axis of pins 73 and 74 | 5 | 127 |
| Height, bottom of bar 82 to bottom of shell 72 (position of FIG. 8) | 2¼ | 5.7 |
| Available space 173 | | |
| Between end of base 56 and arm 83 by resiliently bending arms 83 on arm 82 | 3/16 | 2.6 |
| SKI HOLDING ASSEMBLY 62 | | |
| Base 65 | | |
| Front to rear length of cover 72 | 5.0 | 126 |
| Side to side width of cover 72 | 1⅛ | 28 |
| Thickness of cover 72 (in center thereof) | 1/8 | 3.3 |
| Height of shoulder 79 over top of plate 81 | 7/64 | 3.0 |
| Width of shoulder 79 measured side to side | 3/32 | 2.5 |
| Shoulder 79, front to rear length | 4¼ | 108 |
| Height of cover 81 plus shoulders | 3/16 | 0.5 |
| Bar 67 | | |
| Total height, web 182 plus plates 181 and 183 | ⅝ | 16.6 |
| Plate 183, side to side width | ½ | 12.7 |
| Plate 183, thickness (top to bottom) | 1/8 | 3.3 |
| Plate 181, side to side width | ½ | 12.7 |
| Plate 181, top to bottom thickness | 1/8 | 3.3 |
| Web 182, thickness | .104 | 2.6 |
| Outside length (along plate 183 between intersection of plane of outside edges of plates 184 and 185) | 3¾ | 95.0 |
| Bar 68 | | |
| Outside length, top of 67 to top of cover 81, (as shown in FIG. 9) | 2⅛ | 54.0 |
| Inside length, bottom of 67 to top of 81 (as shown in FIG. 9) | 1½ | 38 |
| Bars 68 and 69 | | |
| Distance from edges 184 to 185 adjacent top of cover plate 81 | 4¾ | 120.0 |
| Enclosure 70 | | |
| Distance between edges 268 and 269 | 3 | 76 |
| Distance between top of cover 81 and bottom of arm or bar 67 | 1-17/32 | 39.0 |
| Pin 73 | | |

TABLE 1-continued

| DIMENSIONS OF APPARATUS 30 | inches | mm. |
|---|---|---|
| Barrel diameter | 1/4 | 6.4 |
| Neck, thickness | 1/8 | 3.2 |
| Head, diameter | 11/32 | 8.7 |
| Total length | 7/8 | 23.0 |
| Shell 72 | | |
| Length projecting from base 65 | 1/2 | 12.5 |
| Height from bottom of shell to cover | 1/2 | 12.5 |
| Outside width at top, below cover 72 | 1.0 | 25.4 |
| Thickness of shell wall | 1/10 | 2.5 |
| Thickness of shell floor | 1/8 | 3.2 |
| Thickness of ribbing members | 1/16 | 1.7 |
| Distance from top of ribbing member to top of wall of shell (height of space 119) | 3/64 | 1.4 |
| Plate 78 | | |
| Material--steel | | |
| Width, front to rear | 3/8 | 9.6 |
| Thickness | 0.4 | .11 |
| Bands 91 and 102 | | |
| Width (front to back, FIG. 9) | 11/16 | 18 |
| Thickness (including beading) | .18 | 4.7 |
| Thickness (excluding beading) | 1.4 | 3.7 |
| Length from link 99 to 96 | 4 3/4 | 125 |
| Pin 124 | | |
| Barrel diameter | 1/4 | 6.4 |
| Collar 304 | 13/32 | 10.5 |
| Pin length | 11/16 | 13.0 |
| SKI POLE HOLDER ASSEMBLY 63: | | |
| Overall height (as in FIG. 8) | | |
| Top surface 257 to bottom surface 258 | 7/8 | 23.0 |
| Overall length | | |
| Face 156 to top rear edge of ledge 164 | 1 5/8 | 42 |
| Face 156 to front edge of ledge 164 | 1-5/16 | 33 |
| Overall width (as in FIG. 14) | | |
| left edge of arm 151 to right edge of arm 154 | 2 3/4 | 72.0 |
| Both ski pole holding units 141 and 142 | | |
| Arms 151 and 154 | | |
| Length, front to rear as in FIG. 8 | 1 1/4 | 33 |
| Thickness (measured radially) | 1/8 | 3.2 |
| Cavities 145 and 146, diameter | 11/16 | 17.5 |
| Arc subtended by each of arms 154, 151, 152 and 155 | 140 degrees | |
| Opening 251 and 254 | 7/16 | 11.5 |
| Ribs 191-198 | | |
| Thickness | 1/16 | 1.6 |
| Maximum depth | 11/64 | 4.1 |
| Distance from front rib to front edge of arms 151 and 154 | 1/8 | 3.2 |
| Distance between ribs (center to center) | 9/16 | 14.2 |
| Distance from rear rib to rear edge of arms 151 and 154 | 9/16 | 14.2 |
| Handle holder unit 143 | | |
| Plate 161, thickness measured transverse to length as in FIG. 8 | 5/32 | 3.7 |
| Interior surface 245, 246 front to rear distance | 17 | 13.7 |
| Plate 162, width | 9/16 | 15.2 |
| Plate 162, angle to bottom surface 258 of core | 75 degrees | |
| Ledge 164, width, from outside of plate 161 to edge 244 | 1/4 | 6.2 |
| Core assembly 144 | | |
| Side to side width, face 257 at top of face 257 | 7/8 | 23.0 |
| Side to side width at bottom face 258 | 7/8 | 23.0 |
| Height of face 153 | 7/16 | 11.5 |
| Height of face 156 | 7/16 | 11.5 |
| Rearward displacement of front edge of top face 153 relative to front edge of arms 151 and 154 | 3/32 | 2.7 |
| Adjustment shim 165 | | |
| Radial thickness | 3/32 | 2.5 |
| Length, front to rear | 1-3/16 | 32 |
| Outside radius of curvature | 11/32 | 8.5 |
| Interior radius | 7/32 | 5.5 |
| Key 167 length | 11/16 | 17.0 |
| Radius of Curvature of rib | 3/16 | 5.0 |
| Key 167, thickness | 1/8 | 3.2 |
| Key 167, height | 1/8 | 3.2 |

I claim:

1. A ski and ski pole carrying assembly comprising a ski holder assembly, a handle assembly and a ski pole holder assembly, the ski holder assembly comprising a ski holder assembly frame and a resilient band, said ski holder assembly frame comprising a rigid horizontally extending base, a rigid vertically extending front bar and a rigid vertically extending rear bar firmly joined together and outlining a ski holder assembly frame enclosure, said band attached to said base, said ski holder assembly base comprising a firmly held pair of spaced apart horizontally extending co-axial rigid pivot means attached to and projecting forward and rearward from said base, hook means supported on said base and said resilient band attached to said base and releasably attached to said hook means, said handle assembly comprising a rigid horizontally extending arm, a rigid front vertically extending arm and a rigid rear vertically extending arm, said vertically extending arms each connected at one end thereof to said horizontally extending arm and, at the other end thereof, pivotally attached to one end of said base, said horizontally extending arm and said front and rear arms and said base outlining a handle enclosure space, said handle assembly and said ski holder assembly pivotally connected to each other for pivotal movement around a longitudinal axis passing through said pivot means, said vertically extending arms extending at an angle to said longitudinal axis passing through said pivot means, said ski pole holder assembly comprising laterally extending left and right ski pole holder units, a handle holder unit, and a core, said ski pole holder units each comprising curved arms at top and bottom of the ski pole holder units, and attached to and extending from said core on opposite sides thereof, said curved arms comprising internally concave sectors of a cylinder and defining a cylindrical ski pole holder unit enclosure therebetween, said handle holder unit comprising vertically and longitudinally extending rigid side plates attached at the front end thereof to the rear face of said core and parallel to each other and transversely and vertically extending ledges attached at the rear of said rigid plates, and said rear face of said core and said rigid plates and said ledges defining a handle holding enclosure, said ledges and said rear face of said core extending parallel to each other and at the same angle to said longitudinal axis passing through said pivot means as the angle at which said vertically extending bars of said handle assembly extend relative to said longitudinal axis passing through said pivot means, one of said vertically extending arms of said handle assembly being releasably engageable with said handle holding enclosure of said ski pole holder assembly, and said ski and ski pole carrying assembly comprising means for releasably holding said ski pole holder assembly in said ski holder assembly frame enclosure, said bars of said ski holder assembly frame locatable within said handle enclosure space.

2. Apparatus as in claim 1 wherein said ski holder assembly enclosure extends around several sides of said ski pole holding assembly, and ledge means on said ski holder assembly frame adjacent to other sides of said ski pole holder assembly, hold said ski pole holder assembly in said ski holder frame enclosure, said ski pole holder assembly being disconnectable from said ski holder assembly by forced distortion of a resilient member of said ski pole holder assembly and wherein said bars of said ski holder assembly are located within said handle enclosure space.

3. Apparatus as in claim 2 wherein said ski holder assembly has a resiliently distortable member to accommodate said ski pole holder assembly to fit into said ski holder assembly frame enclosure.

4. Apparatus as in claim 2 wherein said ski pole holder assembly has a resiliently distortable member to accommodate said ski pole holder assembly to fit into said ski holder assembly frame enclosure.

5. Apparatus as in claim 2 wherein said handle assembly snugly and resiliently fits against opposite ends of said ski holder assembly base and said arms of said handle assembly are movable to accommodate movement of said handle holder unit of said ski pole holder assembly on to said handle assembly and past said ski holder assembly.

6. An apparatus as in claim 5 comprising also a pair of skis and a pair of ski pole assemblies, one of said pair of skis held against each side of said ski holder assembly frame and in contact with said ski holder assembly base, said band extending around and holding each of said pair of skis and, adjacent to the ski holder assembly frame, pressing the soles of said skis against said frame, the soles of said skis contacting each other in front of and to the rear of said ski and ski pole carrying assembly, each of said pair of ski pole assemblies comprising a wheel and a ski pole the ski pole of which is held within the ski pole holder unit enclosure and the wheel of which engages one of said skis.

7. A ski and ski pole carrying assembly comprising a ski holder assembly and a ski pole holder assembly, the ski holder assembly comprising a ski holder assembly frame and a resilient band, said ski holder assembly frame comprising a rigid horizontally extending base, a rigid vertically extending front bar and a rigid vertically extending rear bar firmly joined together and outlining a ski holder assembly frame enclosure, said band attached to said base, said ski holder assembly base comprising a releasable band attachment supported on said base and said resilient band attached at one end to said base and at its other end releasably attached to said releasable band attachment, said ski pole holder assembly comprising laterally extending left and right ski pole holder units, a support holder unit, and a core, said ski pole holder units each comprising curved arms at top and bottom of the ski pole holder units, and attached to and extending from said core on opposite sides thereof, said arms comprising internally concave sectors of a cylinder and defining a cylindrical ski pole holder unit enclosure therebetween, the said support holder unit comprising vertically and longitudinally extending rigid side plates attached at said core and parallel to each other and transversely extending ledges, said core and said rigid plates and said ledges defining a support holding enclosure, and said ski and ski pole carrying assembly comprising means for releasably holding said ski pole holder assembly in said ski holder assembly frame enclosure.

8. Apparatus as in claim 7 including a rigid handle attached to said ski holder assembly.

9. Apparatus as in claim 8 wherein said handle comprises a handle enclosure and said ski holder assembly is movable to within said handle enclosure.

10. An apparatus as in claim 8 with also a pair of skis and a pair of ski pole assemblies, one of said pair of skis held against each side of said ski holder assembly frame and in contact with said ski holder assembly base, said band extending around and holding each of said pair of skis and, adjacent to the ski holder assembly frame, pressing the soles of said skis against said frame, the soles of said skis contacting each other in front of and to the rear of said ski and ski pole carrying assembly, each of said pair of ski pole assemblies comprising a wheel and a ski pole the ski pole of which is held within the ski pole holder unit enclosure and the wheel of which engages one of said skis.

* * * * *